United States Patent [19]

Eberle et al.

[11] Patent Number: 5,007,629

[45] Date of Patent: Apr. 16, 1991

[54] APPARATUS FOR CONVEYING SUBSTANTIALLY FLAT PRODUCTS, ESPECIALLY PRINTED PRODUCTS

[75] Inventors: Jürg Eberle; Hans-Ulrich Stauber, both of Hinwil, Switzerland

[73] Assignee: Ferag AG, Hinwil, Switzerland

[21] Appl. No.: 292,989

[22] Filed: Jan. 3, 1989

[30] Foreign Application Priority Data

Jan. 8, 1988 [CH] Switzerland ..... 50/88

[51] Int. Cl.[5] ..... B65H 5/02

[52] U.S. Cl. ..... 271/277; 271/150; 271/188; 271/206

[58] Field of Search ..... 271/204, 205, 206, 150, 271/277, 188

[56] References Cited

U.S. PATENT DOCUMENTS

| | | | |
|---|---|---|---|
| 4,320,894 | 3/1982 | Reist | 271/277 |
| 4,333,559 | 6/1982 | Reist | 271/204 X |
| 4,424,965 | 1/1984 | Faltin | 271/204 X |
| 4,566,687 | 1/1986 | Faltin | 271/204 X |

FOREIGN PATENT DOCUMENTS

| | | |
|---|---|---|
| 1176675 | 8/1964 | Fed. Rep. of Germany . |
| 0966402 | 8/1964 | United Kingdom . |

*Primary Examiner*—Richard A. Schacher

*Attorney, Agent, or Firm*—Willian Brinks Olds Hofer Gilson & Lione

[57] ABSTRACT

In an imbricated formation delivered by an infeed device in each case two printed products lie in pairs upon one another and, viewed in a predetermined product conveying direction, bear upon the upstream or trailing printed product pair. A suction roll is arranged downstream of the infeed device which causes the current lower printed product to be downwardly bent in a direction transverse to a product conveying plane. The leading edges of the printed products are introduced in such separated or fanned apart condition into a respective gripper, engaged by such respective gripper and outfed in a further predetermined conveying direction. The spacing between neighboring grippers is minimal at a product take-over region, so that when the grippers are open in each instance a leading gripper finger of a trailing gripper bears against a trailing gripper finger of the neighboring leading gripper.

22 Claims, 5 Drawing Sheets

Fig. 4
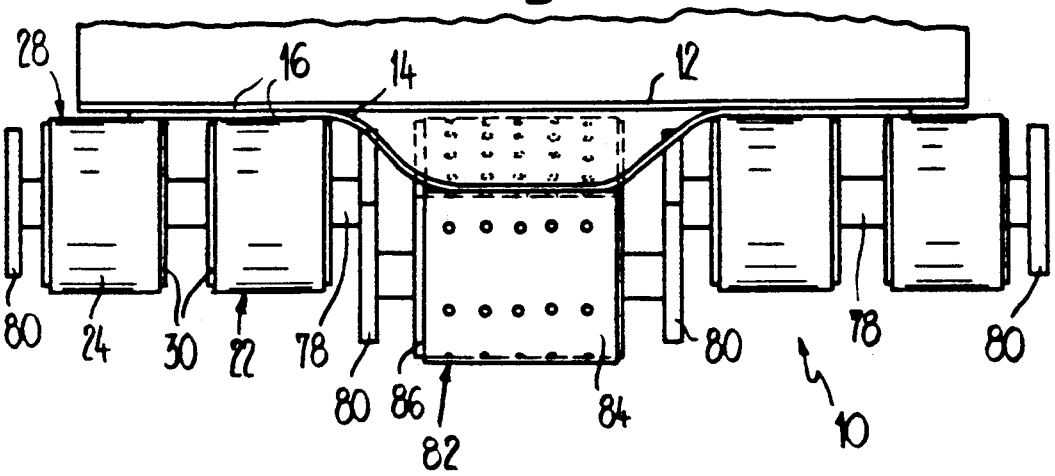
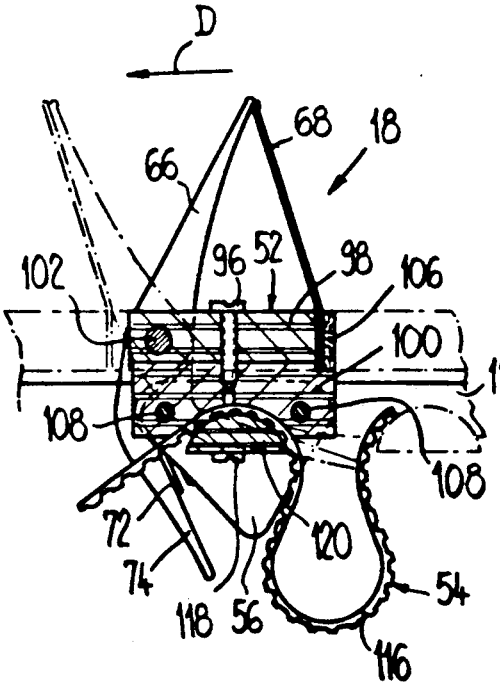
Fig.5
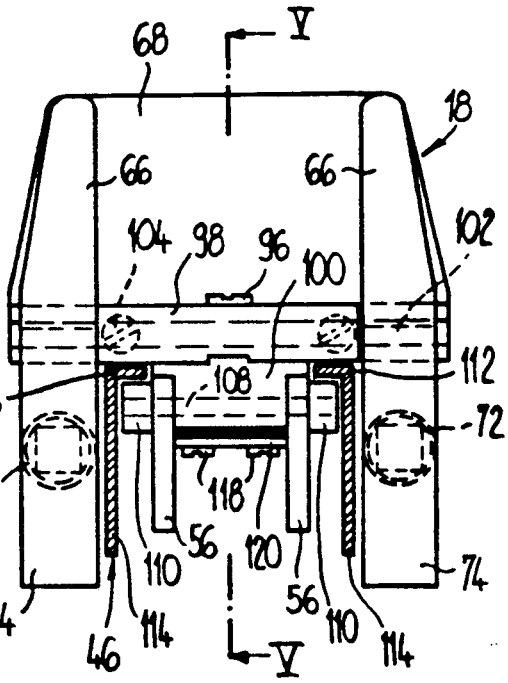
Fig.6

APPARATUS FOR CONVEYING SUBSTANTIALLY FLAT PRODUCTS, ESPECIALLY PRINTED PRODUCTS

CROSS REFERENCE TO RELATED CASE

This application is related to the commonly assigned, co-pending U.S. application Ser. No. 07/316,339, filed Feb. 27, 1989, now U.S. Pat No. 4,953,847 entitled "METHOD OF AN APPARATUS FOR OUT-FEEDING PRINTED PRODUCTS ARRIVING IN AN IMBRICATED FORMATION", and listing as the inventor Werner Honegger.

BACKGROUND OF THE INVENTION

The present invention relates to a new and improved apparatus for the conveying of substantially flat products, especially printed products. Furthermore, this invention relates to a gripper arrangement comprising individually controllable grippers or gripper elements for engaging substantially flat products, especially printed products.

Generally speaking, the conveying apparatus of the present development is of the type comprising an infeed device or conveyor for defining a conveying or conveyor plane for the products. This infeed device serves for the infeed or delivery of the products in an imbricated formation in which in each case a pair of two superimposed products bear in imbricated or shingled formation upon a pair of trailing or upstream products. The infeed device feeds the products to a product take-over region. There is also provided a conveyor device which comprises, viewed in a predetermined conveying direction, successively or tandemly arranged individually controllable grippers or gripper elements for engaging the infed products at the product take-over region at the region of the leading product edges.

According to a further construction of conveying apparatus for substantially flat products, such comprises an infeed device or conveyor which defines a conveying plane for the products and serves to infeed the products in an imbricated formation. In such imbricated product formation each product bears upon the next following or trailing product. The infeed device delivers the products to a product take-over region. There is also provided a conveyor or conveying device which, viewed in a predetermined conveying direction, comprises individually controllable grippers arranged in succession. These individually controllable grippers are provided with gripper or clamp jaws or jaw members for engaging in each instance one of the infed products at the product take-over region and specifically at the region of the leading product edge. The conveying direction of the conveyor device extends transverse to the conveying plane and also extends upwardly from the underside or lower face of the products.

The invention also concerns a gripper arrangement comprising a plurality of individually controllable grippers displaceable in a predetermined product conveying direction. Each of these individually controllable grippers serve to engage substantially flat products infed in a direction extending transversely to the predetermined conveying direction. Each of such individually controllable grippers engage a related product at the leading edge thereof. Moreover each of the individually controllable grippers comprises a gripper body and gripper jaws arranged at the gripper body. At least one closure spring retains the gripper jaws in a closed position and these gripper jaws bear against one another at the region of the free ends of the gripper jaws in the closed position of each individually controllable gripper. Mounting means mount at least one gripper jaw of each gripper at the associated gripper body about an axis extending transversely to the predetermined conveying direction.

A product conveying apparatus of the aforementioned type is known from Swiss Patent No. 637,091 and the corresponding U.S. Pat. No. 4,333,559, granted June 8, 1982. In the imbricated formation which is infed by an infeed device to a conveyor device in each case a pair of two superimposed products bears in imbricated or shingled formation upon a pair of trailing products. The conveyor device comprises a deflection wheel arranged above the infeed device and about which there is guided a traction element. Grippers or gripper elements are provided in tandem or successive arrangement at the traction element in the product conveying direction. Each gripper or gripper element comprises an upper stationary clamp jaw and a lower movable clamp jaw. The grippers brought from above at the imbricated formation engage in each instance a pair of superimposed products at the region of their leading edges by means of the clamp jaws and convey away the products. The conveying direction of the outfeed device or conveyor is essentially parallel at the product take-over region to the conveying direction of the infeed Additionally there is known an apparatus for conveying substantially flat products from Swiss Patent No. 630,583 and the corresponding U.S. Pat. No. 4,320,894, granted Mar. 23, 1982. In the imbricated formation which is delivered by means of an infeed device to a conveyor device each printed product bears upon the next following product. The infeed device transports the products essentially in horizontal direction, whereas the conveying direction of the conveyor device extends from the bottom towards the top. The conveyor device possesses individually controllable grippers arranged at a traction element. At the product take-over region these grippers engage the products infed by the infeed device at their leading product edges and raise such upwardly away from the imbricated formation. Thus, the imbricated product formation is peeled away. In the event that with this known apparatus the conveying velocity of the conveyor device is half as great as the infeed velocity of the infeed device, then in each instance two products in superimposed relationship come into engagement with a gripper, so that in each case two superimposed products can be conjointly raised. With this known apparatus at the infed or delivered imbricated formations, in which in each case an individual product bears upon the next following or trailing product, each individual product is engaged by a gripper and peeled off of the imbricated formation or in each instance two products are displaced upon one another such that each gripper engages two superimposed products and feeds such away.

SUMMARY OF THE INVENTION

Therefore with the foregoing in mind it is a primary object of the present invention to provide an improved construction of apparatus for the conveying of substantially flat products, especially printed products, which enables outfeeding from an infed imbricated formation in which, for instance, in each case a pair of two superimposed products bear in imbricated or shingled formation upon a pair of trailing or upstream products, the products individually so that they can also be singled.

In keeping with the immediately preceding object it is a further object of the present invention to provide an improved construction of gripper or gripper element which is particularly suitable for use with the aforementioned conveying apparatus.

Now in order to implement these and still further objects of the invention, the conveying apparatus of the present development, among other things, is manifested by the features that the conveying direction of the conveyor device extends upwardly transverse to the conveying plane. Additionally, there is provided a separation device which, at the product take-over region, raises from one another or separates or fans apart the leading edges of the pairwise superimposed products in order to be able to infeed to each gripper or gripper element a single product.

According to a further construction of the conveying apparatus there is contemplated an arrangement wherein, at the product take-over region, with the grippers or gripper elements in an open condition or state, a respective at least one gripper or clamp jaw or jaw member of the one gripper bears at a gripper or clamp jaw or jaw member of the neighboring gripper in order to close or cover any possibly existing gap or space between these gripper jaws at the region of the free ends of the gripper jaws.

As indicated previously the invention further pertains to an arrangement of individually controllable grippers wherein at the gripper body of each gripper a gripper jaw or jaw member is fixedly arranged and the other gripper jaw or jaw member of each gripper is pivotably mounted. Each closure or closing spring bears, on the one hand, at the other gripper jaw and, on the other hand, at the gripper body.

It is here remarked that at the product take-over region the leading edges of the pairwise superimposed products are raised or spread from one another and each gripper of the outfeed or conveyor device has delivered thereto a single product. Since the conveying direction of the conveyor device extends upwardly transverse to the conveyor or conveying plane and from the underside or lower face of the products, the pairwise superimposed products can be introduced into the grippers or gripper elements of the conveyor device without having to mutually displace or shift with respect to one another the products in the conveying direction of the infeed device. The thus engaged products are raised away upwardly from the infed imbricated formation or, stated in a somewhat different way, are peeled off the imbricated formation.

According to a particularly simple and preferred embodiment the separation device comprises a separating or separation element. This separating or separation element downwardly bends or flexes the region of the leading edge of the currently or momentarily lower situated product about an axis. This axis extends essentially parallel to the conveyor or conveying plane and transverse to the conveying direction of the infeed device. According to a particularly simple construction the separating or separation element comprises a rotatably driven suction roll or roller which is provided with openings or apertures which are distributed about the circumference or outer surface thereof. This perforated suction roll is operatively connected or periodically connectable with a negative pressure source or suction source. The underside of the momentarily lowermost or lower situated product comes into bearing contact with the circumference of the suction roll and is drawn by the suction roll against the latter, so that the leading edge of this product is separated or distanced or fanned apart from the leading edge of the upper situated product. The separation or detachment of the lower situated product from the suction roll can be accomplished in that the connection between the suction roll and the negative pressure source is interrupted or, for instance, a scraper or stripper element or the like raises such product away from the suction roll.

According to a likewise preferred exemplary embodiment the separation device comprises a bending element which downwardly bends in substantially wave-shaped or undulatory configuration the momentarily lowermost or lower situated product. With this embodiment the leading edges of the superimposed products are separated from one another at the region where the grippers engage such product, whereas the other product regions bear upon or contact one another. In this way there can be detached and peeled off also products possessing an extremely modest or low inherent stiffness or rigidity individually out of the imbricated formation.

Moreover, the conveyor device can comprise a closed or endless guide in which there are revolvingly guided the grippers which are coupled with one another by means of a drag connection. Furthermore, there is provided a drive arrangement or drive means which is synchronized with the infeed device and which acts at least at the start of the conveying-active path of the outfeed device upon the grippers or gripper elements. This affords positive infeed of a respective product to a gripper of the conveyor device in a most simple fashion. In the event that the drag connection between the individual grippers is constituted by an elastic resilient or spring element which can be shortened and lengthened, and wherein at the product take-over region the spacing between neighboring grippers can be adjusted to a fixed amount or value by means of a locking or retarding element or equivalent structure, then phase differences can be compensated between the take-over of the products at the product take-over region and the outfeed thereof at a product transfer region or location following the product take-over region without altering the conveying velocity of the infeed device or conveyor.

The aforedescribed conveying apparatus for the conveyance of superimposed pairs of products can also be used for the conveyance of imbricated formations in which in each case a product bears or lies upon the next following or trailing product. In this case all of the products are influenced or are acted upon in each case by the separation or separating device and delivered to the grippers of the outfeed device or the operation of the separation device is eliminated or suppressed, for instance by disconnecting the coupling or connection between the suction roll or, as the case may be, the recesses or openings in the endless band defining the bending element of the separation device with the negative pressure or suction source.

The aforedescribed second exemplary embodiment of product conveying apparatus is particularly suitable for handling or processing such just described imbricated formations. In the event that with the grippers open at the product take-over region a respective at least one gripper jaw or jaw member of one gripper bears against a gripper jaw or jaw member of the neighboring gripper, then there can be ensured that all of the infed products are engaged by a gripper and transported away since no space or region remains free between the gripper jaws into which there could be accidentally introduced products.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 4 is a fragmentary front view of the infeed device or conveyor of the apparatus depicted in FIG. 3 as viewed generally in the direction of the arrow IV of the arrangement of FIG. 3;

FIG. 5 is a sectional view taken along the line V—V of FIG. 6 and depicting in an enlarged showing a gripper or gripper element of the outfeed device or conveyor of the arrangements depicted in FIGS. 1 to 3;

FIG. 6 is a top plan view of the gripper or gripper element depicted in FIG. 5.

DETAILED DESCRIPTION OF THE PREFERRED EMBODIMENTS

Figure 1:
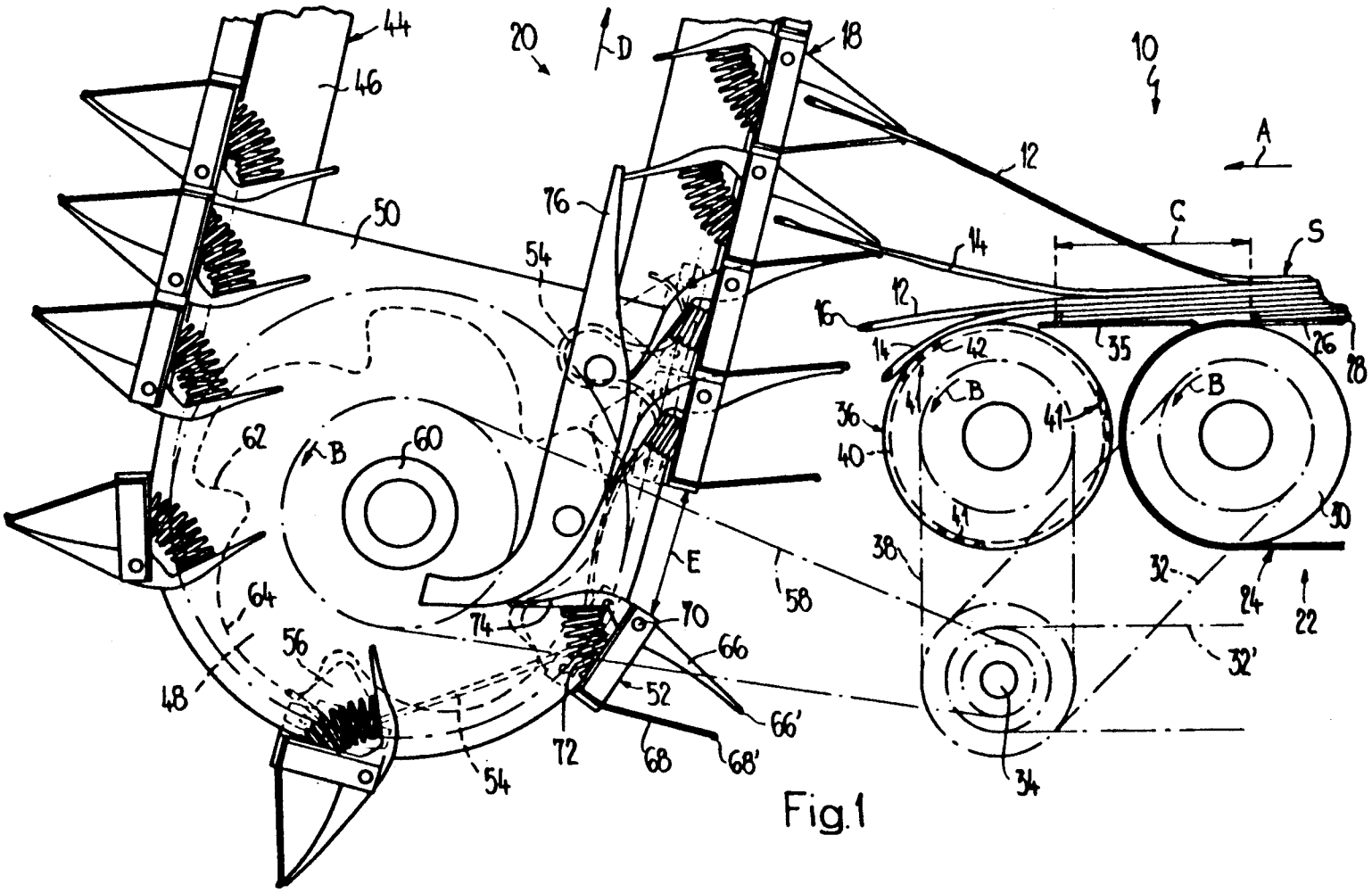
FIG. 1 is a side view of a first exemplary embodiment of an apparatus for the conveying of printed products.

Describing now the drawings, it is to be understood that in order to simplify the illustration thereof only enough of the construction of the exemplary embodiments of product conveying or conveyor apparatuses has been shown so as to enable those skilled in the art to readily understand the underlying principles and concepts of the present invention. Turning attention now to FIG. 1, there is depicted therein a product take-over region of a product conveying or conveyor apparatus comprising an infeed device or infeed conveyor 10 and an outfeed device or outfeed conveyor 20. Printed products 12, 14 which are delivered in an imbricated formation S from the infeed device 10 are individually engaged at the region of their leading product edges 16 by grippers or gripper elements 18 of the outfeed device 20. In the infed imbricated formation S two printed products 12, 14 lie in pairs in superimposed array or fashion, wherein the upper or uppermost situated product of each pair has been designated by reference numeral 12 and the lower or lowermost situated product by reference numeral 14. One such pair of superimposed printed products 12, 14 lies in each case, as viewed in the product conveying direction A of the infeed device 10, upon the next following or trailing or upstream pair of printed products 12, 14.

The infeed device 10 comprises a band or belt conveyor or conveyor means 22 composed of revolvingly driven endless bands or belts 24, only one of which is particularly visible in the showing of FIG. 1. The conveying-active runs 26 of the endless bands or belts 24 of the band or belt conveyor 22 define a conveying or conveyance plane 28 for the imbricated formation S. The endless bands 24 are guided about deflection rolls or rollers 30, and in the illustration of FIG. 1 there has only been depicted the deflection roll 30 at the end of the conveying-active path of the band or belt conveyor 22. The deflection roll 30 is operatively connected by means of the phantom line illustrated chain drive 32 or equivalent structure with a shaft or shaft member 34. This shaft 34 is driven by the phantom line indicated chain drive 32' from a not particularly illustrated but conventional drive motor. The direction of rotation of the deflection roll 30 has been indicated by the arrow B.

Arranged following the band or belt conveyor 22 is a rotatably mounted suction roll or roller 36. Between the band conveyor 22 and the suction roll 36 there is provided at the prolongation or extention of the conveying plane 28 a guide member 35, for instance a sheet metal guide member. The suction roll 36 comprises a hollow cylinder 40 which is operatively connected by means of a further chain drive 38 with the power take-off shaft 34. At three substantially strip-shaped regions 41 of the hollow cylinder 40 and which extend in axial direction thereof and which are mutually offset from one another through an angle of approximately 120° there are provided the radial openings or apertures 42. The perforated suction roll 36 is hermetically closed at its end faces and the thus formed hollow space of the suction roll 36 can be connected in any suitable fashion with a conventional negative pressure source or suction source, generally indicated in FIG. 2 by reference numeral 200. The circumference of the suction roll 36 corresponds to three-times the spacing or distance C between two printed product pairs in the infed imbricated formation S, so that in each case the radial openings or apertures 42 of one region 41 come to bear at the underside or lower face or side of the lowermost or lower printed product 14 at the region of its leading edge 16 and draws such printed product 14 into contact with the outer surface or circumference of the suction roll 36. It is further to be understood that, as viewed in the direction of rotation B of the suction roll 36, the product edge 16 which leads the openings or apertures 42 protrudes or extends away from the suction roll 36. This suction roll 36 separates or fans apart the leading product edges 16 of two superimposed printed products 12, 14 in a direction transverse to the conveying plane 28 and individually delivers such printed products 12, 14 to a respective gripper or gripper element 18. The printed products 12 and 14 which have been depicted uppermost in the right-hand portion of the showing of FIG. 1 are retained by the grippers or gripper elements 18 and, as viewed in the conveying direction D of the outfeed device or conveyor 20, are peeled off or removed from the imbricated formation S.

The conveying direction D of the outfed device or outfeed conveyor 20 extends transversely from the bottom towards the top of the showing of FIG. 1 with respect to the infeed device 10 and is located in a plane which is disposed substantially at right angles to the conveying plane 28.

The outfeed device 20 comprises a revolving guide or guide means 44 which is formed by rails or rail members 46 and at the region of two cam disks, only one of which is visible in FIG. 1, by a guide plate or plate member 50.

In the guide or guide means 44 there are slidingly mounted guide bodies 52 of the grippers 18. These grippers or gripper elements 18 will be described in greater detail hereinafter. The guide bodies 52 are in a mutual drag connection with one another and which drag connection is formed by resilient or spring elements 54 which are pre-biased or loaded in an undulatory or substantially wave-shaped configuration by the guide bodies or body members 52. The spacing E between neighboring guide bodies 52 is alterable as a consequence of the elasticity of the resilient or spring elements 54. As will be best seen by referring to FIG. 1, this spacing or distance E is maximum at the region where entrainment members 56 of the guide bodies 52 engage with the cam disks or cam means 48, whereas the spacing is minimal at the region following the cam disks 48 as viewed in the product conveying direction D.

The cam disks 48 are operatively connected by means of a chain drive 58 with the power take-off shaft or shaft member 34 and are likewise driven in the direction of the arrow B. The cam disks 48 are thus synchronized with the suction roll 36 and the band conveyor 22 and the phase position between the cam disks 48 and the power take-off shaft 34 can be adjusted by means of a phase shifter or shifter means 60.

The cam disks 48 are constructed at their circumference to have a sawtooth-like configuration. The leading steep flanks 62 as viewed in the direction of the arrow B, act in an entraining fashion upon the entrainment members 56, whereas the trailing flat flanks or flank members 64 act in a braking fashion upon the entrainment members 56 so that only a single gripper or gripper element 18 is entrained in each steep flank or flank member 62 and thus the spacing E is enlarged to a maximum between neighboring grippers or gripper elements 18 at the region of the cam disks 48.

Each gripper 18 comprises two fingers or finger members 56 defining a gripper jaw or jaw means and only one of which is visible in the showing of FIG. 1, and a coacting gripper jaw or jaw member 68. These two fingers 66 are arranged at the guide body 52 at the product take-over region in a direction facing towards the band conveyor 22. The trailing gripper jaw 68, as viewed in the product conveying direction D, is fixed at the guide body or body member 52, whereas the leading fingers 56 at such guide body 52 are mounted about a pivot shaft or axle 70 extending perpendicular to the product conveying direction D. The fingers 66 are pre-biased or loaded by means of a respective resilient or spring element 72 in the direction towards a closed position in which the free ends 66' of both fingers 66 bear at the free end 68' of the related clamping jaw 68 or, as the case may be, at a printed product 12, 14. Each finger 56 forms in conjunction with an actuation or actuating element 74 a double-arm lever which is pivotable about the related pivot shaft or axle 70.

At the guide plate 50 there are secured two cams or cam members 76, of which only one is visible in the illustration of FIG. 1. These cam or cam members 76 extend up to the region of the rails or rail members 46 which, as viewed in the product conveying direction D, adjoin such guide plate 50. Upon travel of the actuation elements 74 upon the cams or cam members 76 the fingers or finger members 56 are rocked into an open position against the force of the associated spring 72, and in a subsequent region where the leading edges 16 of the printed products 12 and 14 are introduced between the fingers 66 which are in their open position and the clamping jaw 68, retained in the open position. At a subsequent region where the spacing between the cam members 76 and the guide bodies or body members 52 is increased, the fingers 66 are again rocked back into their closed position owing to the force of their associated springs 72 or equivalent structure.

As already previously explained the spacing or distance E between two neighboring grippers 18 is maximum at the region of the cam disks 48 or equivalent structure owing to the braking action due to the friction between the cams or cam members 76 and the actuation elements 74. The grippers 18 which are released by the steep flanks 62 of the cam disks 48 are braked until the next gripper 18 travels against the braked gripper 18 and pushes such further along. The spacing E between neighboring grippers 18 is thus minimal in the region of the cams 76 following the cam disks 48 as viewed in the conveying direction indicated by the arrow D. The resilient or spring elements 54, which are pre-biased at an average spacing E thus ensure for a quiet operation or running of the apparatus. It is to be observed that with minimum spacing E between neighboring grippers 18 and with the fingers 66 located in their open position, the leading pivotable fingers 66 bear at each instance at the fixed neighboring trailing gripper jaw or jaw member 68 of the gripper or gripper element 18 which leads or is located downstream as viewed in the conveying direction D, so that there is not left free any space or region between the fingers 66 and the gripper jaw 68 of neighboring grippers 18. In this context it is to be observed that it is not necessary that the fingers or finger members 66 bear throughout their entire length against the neighboring gripper jaw 68, rather it is sufficient that a free end 66' bears at the neighboring gripper jaw 68 or conversely. What is important is that any possible gap or space between these gripper jaws 66 and 68 is closed or covered at the region of the free ends 66' and 68'.

Figure 2:
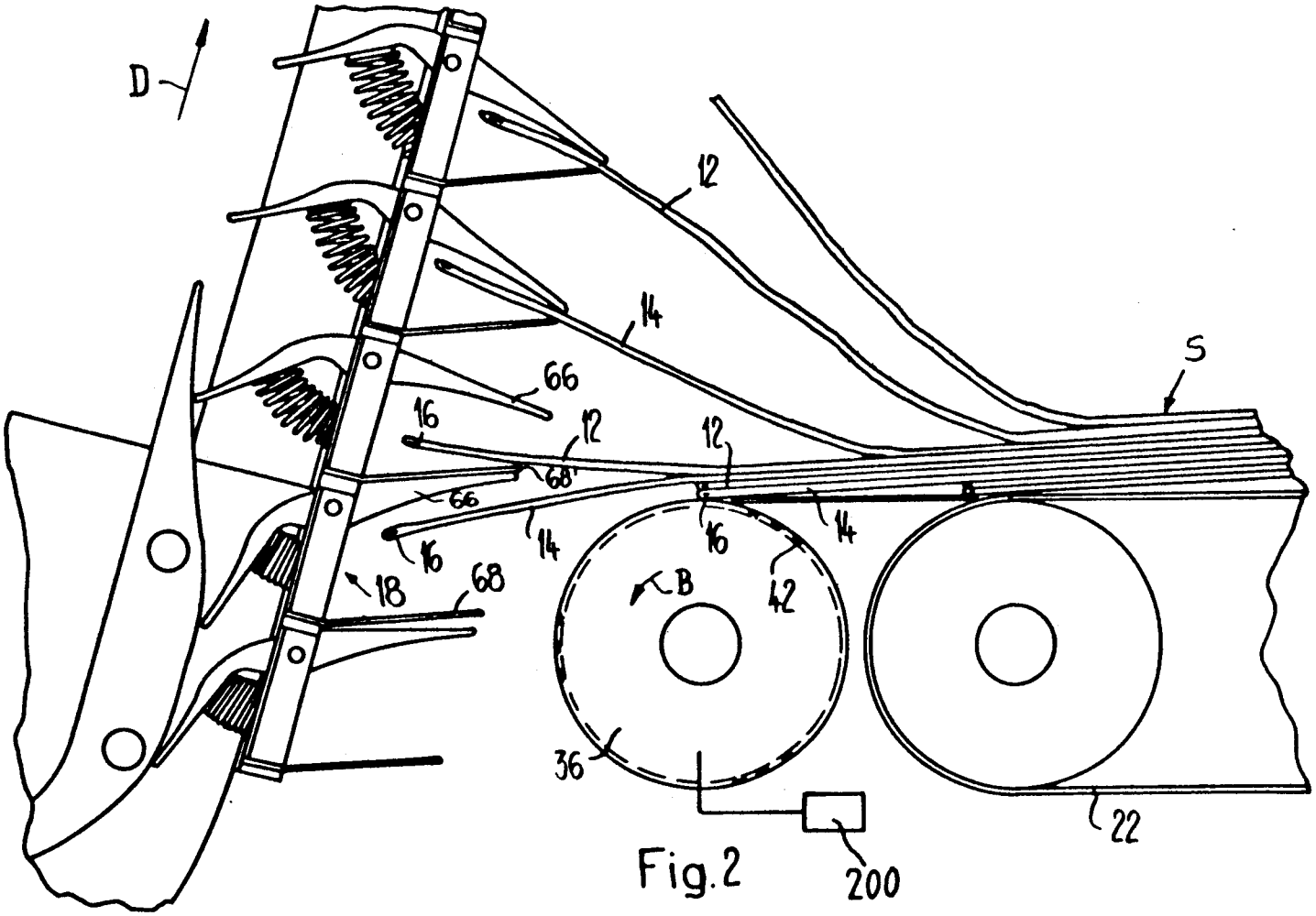
FIG. 2 is a simplified illustrated enlarged detail of the product take-over region of the conveying or conveyor apparatus depicted in FIG. 1.

FIG. 2 illustrates a portion of the apparatus depicted in FIG. 1 in a simplified and enlarged representation. The reference characters used in FIG. 2 generally correspond with the reference characters employed in the arrangement of FIG. 1 and are only repeated to the extent that they are needed for comprehending the arrangement of FIG. 2. In contrast to FIG. 1 the suction roll or roller 36 has been shown rotated through an angle of about 45° in the direction of the arrow B. A leading product edge 16 of a lower situated printed product 14 of the superimposed printed products 12, 14 of the imbricated formation S infed by the band or belt conveyor 22 bears against the suction roll 36. The leading edge 16 of the lower situated printed product 14 of the printed product pair which bears upon the printed product pair still at the region of the suction roll 36, is located at the region of the fingers 66 disposed in their open position and the gripper jaw 68 of a gripper 18, whereas the upper situated printed product 12 bears at the free end 68' of the gripper jaw 68 of the leading gripper 18 and the fingers 66 move back from the open position into the closed position. The grippers 18 which lead the aforementioned grippers 18 as viewed in the conveying direction D either have engaged an upper situated or a lower situated printed product 12 or 14, as the case may be, and peel such off of the imbricated formation S.

The mode of operation of the apparatus depicted in FIGS. 1 and 2 is as follows:

The suction roll 36 which rotates in the direction of the arrow B is synchronized in respect of the imbricated formation S delivered by the band conveyor 22 in such a manner that the leading product edge 16 of the currently or momentarily lower situated printed product 14, viewed in the conveying direction A, comes to bear at a short spacing in front of a strip-shaped region 41 of openings or apertures 42, as such have been depicted in FIG. 2. Since the interior or internal chamber of the suction roll 36 is connected, as previously explained, with a negative pressure or suction source 200, during further rotation of the suction roll 36 the under or lower side or face of the lower situated printed product 14 is drawn against the suction roll 36 against the region of the openings 42. Consequently, during further rotation of the suction roll 36 in the direction of the arrow B, as such has been depicted in FIG. 1, the leading product edge 16 of the lower situated printed product 14 is separated or distanced from the leading edge 16 of the upper situated printed product 12. The leading edge 16 of the upper situated printed product 12 is directly introduced into an open gripper or gripper element 18, and the suction roll 36 prevents that also the leading edge 16 of the lower situated printed product 14 can arrive at the same gripper or gripper element 18.

As soon as the leading edge 16 of the upper situated printed product 12 has crossed or intersected the path of movement of the free end 68' of the gripper jaw 68, then upon detachment of the lower situated printed product 14 from the suction roll 36 the leading product edge 16 likewise is introduced into a gripper or gripper element 18 which is located in its open position as such has been depicted in FIG. 2. The inherent stiffness or elasticity of the printed products 12, 14 ensure in each case that, firstly, the upper situated printed product 12 moves essentially in the conveying direction A into the open gripper or gripper element 18, and that secondly, the lower situated printed product 14 which has been freed from the suction roll 36 detaches from such suction roll 36 and rocks or moves upwardly into the region of the open gripper 18, as again will be recognized by inspecting FIG. 2. The detachment of the lower situated printed product 14 from the suction roll 36 is accomplished by intermittently or briefly interrupting the connection between the interior of the suction roll 36 and the negative pressure or suction source 200. However, it is also to be understood that the suction roll 36 can be continuously connected with the negative pressure source 200 if, for instance, the lower situated printed product 14 is detached from the suction roll 36 by means of a not particularly illustrated scraper or stripper or equivalent structure. As soon as the leading edges of the printed products 12, 14 are located by an adequate amount behind the free ends 66' and 68' of the fingers 66 and the gripper jaws 68, respectively, such product edges 16 and printed products 12, 14 are fixedly clamped by the fingers 66 and conveyed away in the direction of the arrow D. It is to be remarked that the printed products 12, 14 are engaged by the grippers or gripper elements 18 along a line and the leading edges 16 can freely move between the fingers 66 and the gripper jaw 68 of the related gripper 18.

Figure 3:
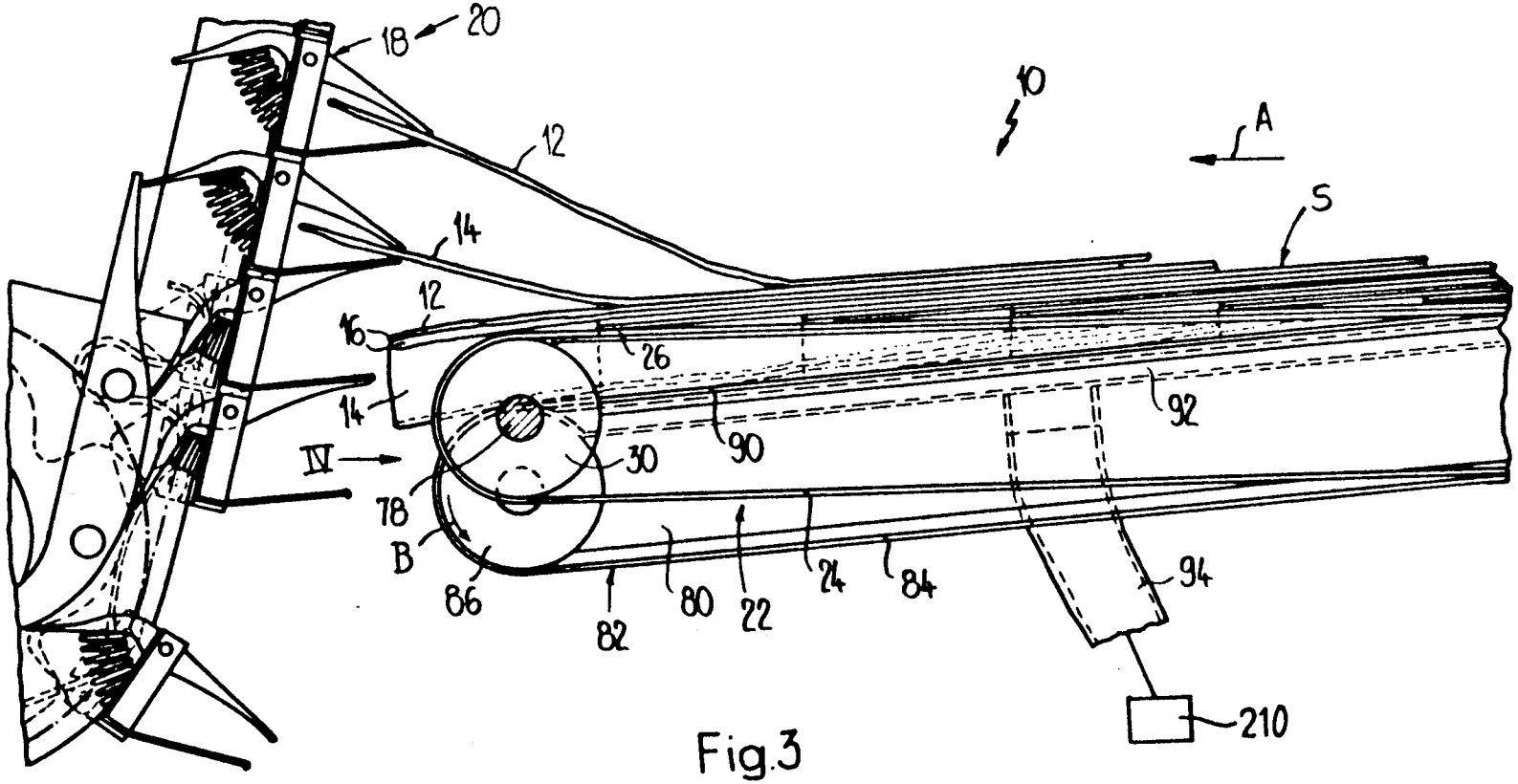
FIG. 3 likewise shows in side view a second exemplary embodiment of apparatus for conveying printed products.

The outfeed device 20 depicted in FIG. 3 corresponds to the previously described outfeed device 20 illustrated in FIG. 1. It is for this reason that further description of this outfeed device or outfeed conveyor 20 of the modified product conveying apparatus of FIGS. 3 and 4 is thought unnecessary. The infeed device or infeed conveyor 10 depicted in such modified arrangement of FIGS. 3 and 4 will be seen to comprise a band or band conveyor or conveyor means 22 having four mutually parallel extending endless bands or belts 24. Each endless band or belt 24 is guided about a deflection roll 30 at the end of the conveying-active path and in each case two deflection rolls 30 of two neighboring endless bands or belts 24 are rigidly or fixedly seated for rotation upon a rotatable shaft or shaft member 78. These shafts 78 are mounted at both ends at bearing plates or brackets 80 and are driven in a comparable fashion as has been depicted and described previously in FIG. 1.

The conveying-active runs 26 of these endless bands or belts 24 define the conveying plane 28 for the printed products 12 and 14 which are infed or delivered in imbricated formation S. At the central region between the laterally pairwise arranged endless bands 24, as viewed in the conveying direction A, there is provided a further band or belt conveyor 82. This further band or belt conveyor 82, defining a product bending element, comprises a perforated endless band or belt 84 which is guided about further deflection rolls or rollers 86, there only being illustrated the deflection roll 86 at the end of the conveying-active path or stretch. This deflection roll 86 is likewise mounted at bearing plates 80 or equivalent structure and can be synchronously driven with respect to the deflection rolls 30 in the direction of the arrow B. The conveying-active run of the perforated band or belt conveyor 82 or equivalent structure is located at the starting region of the conveying-active path in the conveying plane 28 and moves away in downward direction as viewed in the direction of the arrow A. Both of the deflection rolls 30 and 86 are offset in vertical direction at the end of the conveying-active path approximately by an amount corresponding to one-half the diameter of the deflection rolls 30 and 86. The conveying-active run of the band conveyor 82 travels over a substantially channel-shaped suction trough or vat 92 which is connected by means of a line or conduit 94 with a negative pressure source or suction source, generally indicated by reference numeral 210.

Having now had the benefit of the foregoing description of the modified embodiment of conveying apparatus as considered with respect to FIGS. 3 and 4 the operation thereof will be now explained and is as follows:

At the start of the conveying-active path of the band or belt conveyor 22 pairs of superimposed arrayed printed products 12 and 14 of the imbricated formation S bear in each case against one another. Upon travel of these printed products 12 and 14 onto the conveying-active run 90 of the downwardly directed and outbound traveling perforated band or belt conveyor 82 the underside or bottom face of the lower or lowermost printed product 14 is drawn, due to the negative pressure or suction prevailing in the suction trough or vat 92, against the perforated endless band or belt 84. During the course of the further product transport in the direction of the arrow A the lower situated printed product 14 bends out or bows in a substantially wave-shaped or undulatory configuration, and the upper situated printed product 12 retains its linear or straight configuration or orientation owing to its inherent stiffness or rigidity. The thus formed wave trough or valley existing in the bent or bowed lower situated printed product 14 travels essentially in the direction of the arrow A. The leading edges 16 of both printed products 12 and 14 bear against one another at the lateral marginal or edge regions as viewed in the conveying direction A, whereas at the central product region, and specifically at the region of the band or belt conveyor 82 these printed products 12 and 14 are spaced from one another in a direction transverse to the conveying plane 28, as best seen by referring to FIG. 4. The thus mutually spaced leading edges 16 of both printed products 12 and 14 are each introduced into an associated open gripper or gripper element 18 at the outfeed device or conveyor 20, grasped or seized by such grippers 18 at the leading edges 16 and singled and removed out of the imbricated formation S.

FIGS. 5 and 6 respectively depict in a sectional view taken substantially along the line V—V of FIG. 6 and in top plan view and on an enlarged scale a gripper or gripper element 18 of the outfeed device or conveyor 20. The gripper guide body 52 comprises two partial bodies or body members 98 and 100 which are threadably interconnected by a threaded bolt or screw 96 or equivalent fastening expedient. At the partial body 98 there are pivotably mounted at a pivot shaft or shaft member 102 two parallel fingers or finger members 66 defining a gripper jaw. The other coacting gripper jaw 68 is of substantially blade or leaf-shaped or plate-like configuration and is likewise secured at the partial body or body member 98 by means of further threaded bolts or screws 104 or the like. At the region of the bolt heads of such threaded bolts or screws 104 there is arranged a shock absorber or cushioning damper 106, for instance, a rubber strip or the like, which is intended to prevent any forceful or pronounced mutual impact of neighboring grippers against one another when they assume the minimum or minimal distance E, as is the case shown for certain of the grippers in the illustration of FIG. 1. The fingers 66 have been depicted in full line in the closed position, whereas the open position of such fingers 66 has been portrayed in phantom lines in FIG. 5. In this open position of the gripper 18 such bears against the gripper jaw 68 of the neighboring gripper 18 as likewise depicted in phantom lines. The actuation elements 74 of the fingers 66, as viewed in the conveying direction D, are slightly bent or flexed towards the rear in order that the travel of the actuation elements 74 onto the related cams or cam members 76 (see also FIG. 1) which coact with a respective finger or finger member 66 can be accomplished without any problem, and furthermore, upon closing of the fingers 66 there cannot arise between the associated cam 76 and the actuation element 74 any clamping or binding action.

The resilient elements or springs 72 bear at one end against the actuation element 74 and at the other end at the partial bodies 98. Informative in this respect is also the illustration of FIG. 1. At the end face of each partial body 100 there is secured a respective entrainment member 56 by means of bolts 108 or equivalent structure. These bolts 108 possess bolt heads 110 at both ends. In the gap or space between the partial body 98 and the bolt heads 110 there slide the confrontingly directed or facing flanks 112 of substantially L-shaped profiles or profile members 114 of the rails or rail members 46 and which are arranged substantially parallel to one another.

The resilient or spring element or resilient or spring means 54 is formed by portions or sections of a toothed belt or belt member 116 which is arranged between neighboring grippers or gripper elements 18. The partial body or body member 100 possesses a substantially saddle-shaped recess in which there can be arcuately drawn or placed the toothed belt 116 by means of a so-called rider or securing member 120 which is attached by means of threaded bolts or screws 118 or the like at the associated partial body 100. With minimum spacing E between neighboring grippers 18 (see also FIG. 1) the sections or portions of the toothed belt 116 are markedly flexed or bent in an undulatory configuration, whereas with maximum spacing E these sections or portions of the toothed belt 116 extend practically linearly or in substantially straight orientation. Owing to the elasticity of the toothed belt 116 and with minimum spacing or distance E between neighboring grippers 18 this toothed belt acts in a repelling fashion, in other words biases away such neighboring grippers 18 from one another and, conversely, when such toothed belt 116 is extended or straighted it tends to draw neighboring grippers towards one another.

It is also conceivable that the drag connection between the gripper 18 retains these grippers 18 at a fixed mutual spacing E from one another, but in that case, during operation of the apparatus, there must not arise any phase shifts between the product take-over cycle or operating rhythm of the outfeed device or conveyor 20 and the product delivery cycle. If as is depicted in FIGS. 1, 3 and 5 the drag connection or connection means is constituted by a resilient or spring element 54 (here for instance by way of example a toothed belt 116), then as viewed in the conveying direction D and at a location following the product take-over region the mutually spacing E between the grippers or gripper elements 18 can be enlarged so that it is readily possible to compensate a difference in the phase in the take-over cycle and the delivery or outfeed cycle of the outfeed conveyor 20.

It is also to be understood that the apparatus can be employed for the transport of imbricated formations S in which in each instance only one product bears upon the next following or upstream product. In this case there can be eliminated the connection of the suction roll 36 (FIG. 1) or the suction trough or vat 92 (FIG. 3) with the negative pressure source 200 and 210, respectively. The products are thus individually and directly introduced in the conveying direction A into the open grippers or gripper elements 18.

It is to be remarked that in both exemplary embodiments according to FIGS. 1 to 4 the superimposed printed products 12 and 14 are not mutually shifted in relation to one another with respect to the conveying direction A.

The grippers or gripper elements also can be arranged at a traction element, for instance, a ball-and-socket joint-link chain, as disclosed for instance in the aforementioned Swiss Patent No. 630,583 and the cognate U.S. Pat. No. 4,320,894. The gripper bodies of the grippers 18, at which there are arranged the fingers 66 and the gripper jaws or jaw members 68, are thus secured at cantilever members of the ball-and-socket joint-link chain. In the case of constructions in which the grippers 18 are slidably mounted in a guide or guide means 44 the guide bodies 52 form the gripper bodies.

Figure 7:
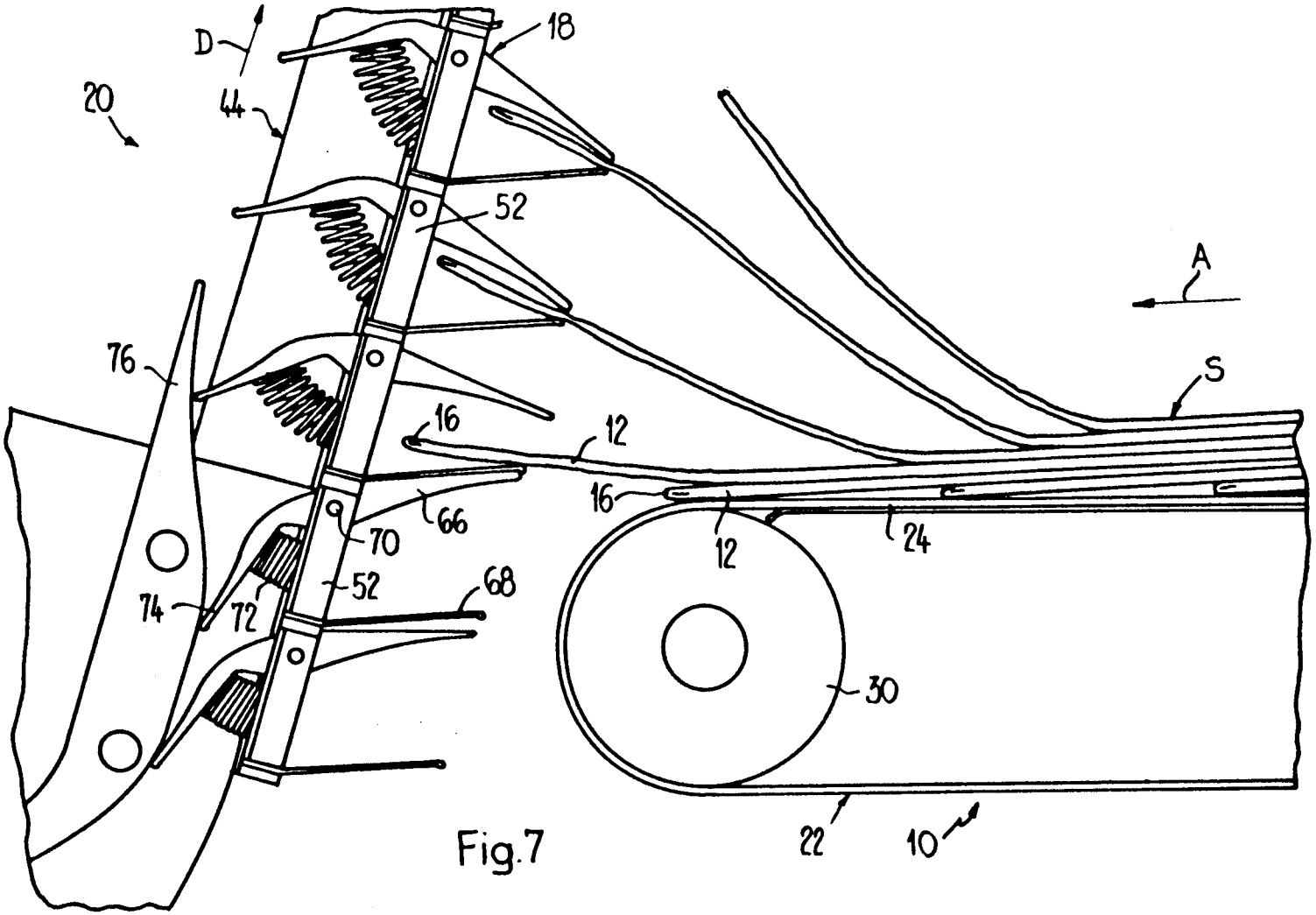
FIG. 7 is a side view of a third exemplary embodiment of product conveying or conveyor apparatus wherein in the infed imbricated formation in each case a printed product bears upon the next following or upstream printed product.

The further modified construction of product conveying or transport apparatus as depicted in FIG. 7 comprises an infeed device or conveyor 10 and an outfeed device or conveyor 20. This outfeed device or conveyor 20 likewise corresponds to the outfeed device or conveyor 20 illustrated and described in conjunction with FIGS. 1, 2 and 3. The infeed device or conveyor 10 is constructed as a band or belt conveyor 22 containing mutually parallel extending endless bands or belts 24, of which only a single such endless band or belt has been depicted in FIG. 7. Each endless band or belt 24 is guided about a deflection roll 30 at the end of the conveying-active path or stretch of the band or belt conveyor 22. Only one of the deflection rolls 30 is shown in FIG. 7 and the deflection rolls which are present at the start of the conveying-active path have not been depicted in FIG. 7 to simplify the illustration thereof. The band or belt conveyor 22 conveys an imbricated formation S in the product conveying direction A, and in each case one printed product 12 bears upon the next following or upstream printed product 12. As to these printed products 12 the leading product edges have been conveniently designated again by reference character 16.

In the guide or guide means 44 of the outfeed device 20 there are slidingly guided the successively or tandemly arranged grippers or gripper elements 18 as such has already been discussed previously. The drive connection between the grippers or gripper elements 18 is rigidly constructed so that the guide bodies or body members 52 of neighboring grippers or gripper elements 18 continuously bear against one another. The gripper jaws 68 of each gripper 18, and which trails in the conveying direction D, is affixed to the associated guide body or body member 52, whereas the leading fingers or finger members 66 are mounted at the pivot shaft or axle 70. At each actuation or actuating element 74 of a finger 66 there bears a resilient element or spring 72 which bears at its opposite end at the guide body 52. The fingers 66 of a gripper 18 and which are retained by the cams or cam members 76 in the open gripper position bear at the associated gripper jaw 68 of the gripper 18 which leads as viewed in the conveying direction D.

The mode of operation of the conveying apparatus depicted in FIG. 7 will now be explained and is as follows:

Each opened gripper or gripper element 18 has infed thereto the leading edge 16 of a printed product 12. Owing to the enlargement of the spacing between the cams or cam members 76 and the guide or guide means 44 in the conveying direction D, the gripper or gripper elements 18 close. Consequently, the fingers 66 come to bear at the associated gripper jaw or jaw member 68 or, as the case may be, at the printed product 12 now located between the fingers 66 and the associated gripper jaw 68. Hence, each gripper 18 seizes or engages a printed product 12 and peels such off of the imbricated formation S. In the gripper open position the fingers 66 of a gripper 18 lie against the clamping jaw 68 of the leading gripper 18 so that there does not remain free any intermediate space or gap between neighboring grippers or gripper elements 18 at the zone of the product take-over region and the infed printed products 12 are positively introduced into the grippers 18. Of course, the conveying velocity of the outfeed device or outfeed conveyor 20 is accommodated or coordinated with the conveying velocity of the infeed device or infeed conveyor 10 and the spacing or pitch between leading product edges 16 of the imbricated formation S of printed products.

While there are shown and described present preferred embodiments of the invention, it is to be distinctly understood that the invention is not limited thereto, but may be otherwise variously embodied and practiced within the scope of the following claims.

What we claim is:

1. An apparatus for conveying substantially flat printed products, comprising:

an infeed device for the infeed of products in the imbricated formation in which a pair of two superposed products are laid one on top of the other such that all like parts coincide, and in which said pair of two superposed products bear in imbricated formation upon a pair of upstream products with respect to a predetermined direction of travel of the imbricated formation;

said infeed device defining a conveying plane for the products and delivering the products to a take-over region;

a conveying device having a predetermined direction of travel;

said conveying device being provided with individually controllable grippers arranged in succession in said predetermined direction of travel of said conveying device;

said individually controllable grippers serving for engaging the infed products at leading product edges at the take-over region;

said predetermined direction of travel of the conveying device extending from an underside of the products upwardly and transversely with respect to the conveying plane of the infeed device; and a separation device for spacing from one another at the take-over region the leading edges of the pairs of superposed products in order to introduce into each gripper a single product.

2. The apparatus as defined in claim 1, wherein:

said infeed device comprises band conveyor means.

3. The apparatus as defined in claim 2, wherein:

said separation device comprises a separation element; and said separation element downwardly bending a region of the leading edge of each lower product of the pair of superimposed products about an axis extending substantially parallel to the conveying plane and transversely to a predetermined conveying direction of the infeed device.

4. The apparatus as defined in claim 1, wherein:

said separation device comprises a separation element; and said separation element downwardly bending a region of the leading edge of each lower product of the pair of superimposed products about an axis extending substantially parallel to the conveying plane and transversely to a predetermined conveying direction of the infeed device.

5. The apparatus as defined in claim 4, further including:

a negative pressure source;

said separation element comprising a rotatably driveable suction roll capable of being operatively connected with said negative pressure source;

said suction roll having an outer surface; and said outer surface of said suction roll being provided with circumferentially distributed openings against which come to bear an underside of the lower situated product of each pair of superimposed products.

6. The apparatus as defined in claim 5, wherein:

said suction roll has an axial direction; and said openings of said suction roll being arranged within at least one substantially strip-shaped region of the suction roll and which extends essentially in axial direction of the suction roll.

7. The apparatus as defined in claim 1, wherein:
said separation device comprises means defining a bending element for downwardly bending in substantially wave-shaped configuration the lower product of each pair of superimposed products.

8. The apparatus as defined in claim 2, wherein:
said separation device comprises means defining a bending element for downwardly bending in substantially wave-shaped configuration the lower product of each pair of superimposed products.

9. The apparatus as defined in claim 8, wherein:
said band conveyor means comprises at least two substantially mutually parallel laterally spaced revolvingly driveable endless bands between which there is arranged said bending element.

10. The apparatus as defined in claim 9, wherein:
said endless bands have conveying-active runs defining the conveying plane;
said bending element comprising at least one further band conveyor which is oriented downwardly, as viewed in the conveying direction of the infeed device, out of the conveying plane defined by the conveying-active runs of the endless bands;
said further band conveyor comprising an endless perforated band provided and movable along a conveying-active path; and
a negative pressure source with which there is connected the perforated endless band.

11. The apparatus as defined in claim 1, wherein:
said conveying device comprises endless guide means;
drag connection means for intercoupling said grippers with one another;
said grippers being revolvingly guided in said endless guide means;
an outfeed device for the outfeed of the printed products and defining a conveying direction;
said outfeed device having a conveying-active path including a starting region;
drive means acting upon said grippers at least at the start of the conveying-active path of the outfeed device; and
said drive means being synchronized with said infeed device.

12. The apparatus as defined in claim 11, wherein:
said drag connection means between individual grippers is constituted by an elastic resilient element whose length can be increased and shortened; and
a retarding element for adjusting at the take-over region the spacing between neighboring grippers to a predetermined value.

13. The apparatus as defined in claim 12, wherein:
said predetermined value constitutes a fixed minimum value.

14. The apparatus as defined in claim 12, wherein:
each gripper comprises gripper jaw means between which there is taken-up a related printed product;
each of the said grippers being capable of selectively assuming an open gripper position and a closed gripper position; and
with a gripper open at the take-over region at least one gripper jaw means of one gripper bearing against a gripper jaw means of a neighboring gripper in order to close or cover a possible gap between said gripper jaws at the region of free ends of the gripper jaws.

15. The apparatus as defined in claim 14, wherein:
each gripper comprises a guide body at which there is fixedly arranged an associated one gripper jaw means;
the other gripper jaw means of each gripper comprising finger means having free ends;
means for pivotably mounting said finger means about an axis extending essentially transversely to the conveying direction of the outfeed device; and
said finger means in the closed position of the gripper engaging at the associated gripper jaw means or at a seized product.

16. The apparatus as defined in claim 15, wherein:
the one gripper jaw means of each gripper which is fixedly arranged at the guide body comprises a trailing gripper jaw means;
said finger means comprising two fingers; and
said fingers in the closed position of the associated gripper only bearing at their free ends at the associated gripper jaw means or at the seized product.

17. The apparatus as defined in claim 15, further including:
closing spring means for retaining the pivotably mounted fingers of each gripper in a closed position;
actuation means provided for said fingers of each gripper; and
opening cam means engageable with said actuation means of said fingers of each gripper for placing each gripper in an open position.

18. The apparatus as defined in claim 17, wherein:
said open cam means comprise retarding means.

19. An apparatus for conveying substantially flat printed products, comprising:
an infeed device for the infeed of products in an imbricated formation wherein each product bears upon a trailing product with respect to a predetermined direction of movement of said products;
said infeed device defining a conveying plane and a conveying direction for said products;
said infeed device delivering said products to a take-over region;
a conveyor device having a predetermined product conveying direction;
said conveyor device being provided with a plurality of individually controllable grippers arranged in succession in said predetermined conveying direction
said individually controllable grippers comprising gripper jaws for seizing an infed product at the take-over region at a leading edge of said infed product;
said predetermined conveying direction of said conveyor device extending upwardly from an underside of each product transversely with respect to the conveying plane of the infeed device;
said conveyor device comprising drag connection means for intercoupling said grippers with one another;
said conveyor device having a conveying-active path including a starting region;
drive means acting on said grippers at least at the starting region of the conveying-active path of the conveyor device;
said drive means being synchronized with said infeed device;
retarding means for adjusting at the take-over region the spacing between neighbouring grippers to a predetermined value;

each of said grippers being capable of selectively assuming an open position and a closed position;

at least one gripper jaw of one gripper bearing against a gripper jaw of a neighbouring gripper at the take-over region in order to close or cover any existing gap prevailing between the gripper jaw of the one gripper and the gripper jaw of the neighbouring gripper at the region of free ends of such grippers jaws.

20. The apparatus as defined in claim 19, wherein said predetermined value comprises a fixed minimum value.

21. The apparatus defined in claim 19, wherein:

said drag connection means between individual grippers comprises an elastic resilient element whose length can be increased and shortened.

22. An apparatus for conveying substantially flat printed products, comprising:

an infeed device for the infeed of products in the imbricated formation in which a pair of two superposed products are laid one on top of the other such that all like parts coincide and in which said pair of two superposed products bear in imbricated formation upon a pair of upstream products with respect to a predetermined direction of travel of the imbricated formation;

said infeed device defining a conveying plane for the products and delivering the products to a take-over region;

a conveying device having a predetermined direction of travel;

said conveying device being provided with individually controllable grippers arranged in succession in said predetermined direction of travel of said conveying device;

said individually controllable grippers serving for engaging the infed products at leading product edges at the take-over region;

said predetermined direction of travel of the conveying device extending from an underside of the products upwardly and transversely with respect to the conveying plane of the infeed device;

drag connection means for intercoupling said grippers with one another;

said drag connection means permitting an alteration of the spacing between neighboring grippers;

drive means acting on said grippers before the take-over region;

said drive means being synchronized with said infeed device;

adjusting means for adjusting at the take-over region the spacing between neighboring grippers to a predetermined value; and a separation device for spacing from one another at the take-over region the leading edges of the pairs of superposed products in order to introduce into each gripper a single product.

* * * * *

UNITED STATES PATENT AND TRADEMARK OFFICE
CERTIFICATE OF CORRECTION

PATENT NO. : 5,007,629

DATED : April 16, 1991

INVENTOR(S) : Jurg Eberle et al.

It is certified that error appears in the above-identified patent and that said Letters Patent is hereby corrected as shown below:

IN THE ABSTRACT

On the cover page on line 6 of the Abstract, after "device" please insert --,--.

In column 2, line 28, after "infeed" please insert --.--.

Column 14:

In claim 3, line 6, please delete "superimposed" and substitute therefor --superposed--.

In claim 4, line 6, please delete "superimposed" and substitute therefor --superposed--.

Column 15 claim 7, line 5, please delete "superimposed" and substitute therefor --superposed--.

In claim 8, line 5, please delete "superimposed" and substitute therefor --superposed--.

Column 16 claim 18, line 2, please delete "open" and substitute therefor --opening--.

UNITED STATES PATENT AND TRADEMARK OFFICE

CERTIFICATE OF CORRECTION

PATENT NO. : 5,007,629

DATED : April 16, 1991

INVENTOR(S) : Jurg Eberle et al.

It is certified that error appears in the above-identified patent and that said Letters Patent is hereby corrected as shown below:

Column 16:

In claim 19, lines 15 and 16, after "direction" please insert --;--.

Signed and Sealed this

Twenty-ninth Day of September, 1992

*Attest:*

DOUGLAS B. COMER

*Attesting Officer*

*Acting Commissioner of Patents and Trademarks*